US009885205B2

(12) United States Patent
Janzen

(10) Patent No.: US 9,885,205 B2
(45) Date of Patent: Feb. 6, 2018

(54) DAMPING DEVICE FOR THE DAMPING OF THE OPENING MOVEMENT OF A MOVEABLE FURNITURE PART

(71) Applicant: Grass GmbH, Höchst (AT)

(72) Inventor: Jörg Janzen, Lustenau (AT)

(73) Assignee: GRASS GMBH, Höchst (AT)

( * ) Notice: Subject to any disclaimer, the term of this patent is extended or adjusted under 35 U.S.C. 154(b) by 0 days.

(21) Appl. No.: 15/255,883

(22) Filed: Sep. 2, 2016

(65) Prior Publication Data

US 2017/0067277 A1 Mar. 9, 2017

(30) Foreign Application Priority Data

Sep. 4, 2015 (DE) ..... 20 2015 006 279 U

(51) Int. Cl.
*E05F 3/02* (2006.01)
*E05F 5/00* (2017.01)
(Continued)

(52) U.S. Cl.
CPC ..... *E05F 3/02* (2013.01); *A47B 88/10* (2013.01); *A47B 88/473* (2017.01); *E05F 3/04* (2013.01);
(Continued)

(58) Field of Classification Search
CPC ..... A47B 88/473; A47B 88/477; A47B 88/04; A47B 88/0477; A47B 88/481; A47B 2210/0091; A47B 2210/0094; E05F 5/003
See application file for complete search history.

(56) References Cited

U.S. PATENT DOCUMENTS 8,939,525 B1 * 1/2015 Chen ..... A47B 88/047 312/333
2009/0309470 A1 * 12/2009 Ruter ..... A47B 88/467 312/334.1
(Continued)

FOREIGN PATENT DOCUMENTS

DE 202004006410 U1 9/2005
DE 102010036741 A1 2/2011
(Continued)

OTHER PUBLICATIONS

European Search Report in corresponding European Patent Application No. 16184015, completed on Jan. 17, 2017, with English translation.
(Continued)

*Primary Examiner* — Daniel J Rohrhoff
(74) *Attorney, Agent, or Firm* — Edell, Shapiro & Finnan LLC

(57) ABSTRACT

A damping device for the damping of the opening movement of a movable furniture part comprises: a fixed base unit with a furniture body of a piece of furniture; a movable base unit having the movable furniture part; and a damping unit comprising a first and a second damping component which are movable relative to one another when performing a damping function, of which the first damping component is arranged on the one base unit and as it approaches the movable base unit an impact takes place in the final position of said base unit between the second damping component and the other base unit, thereby triggering the damping function the first damping component is movably mounted on the allocated base unit such that on impact it can be displaced from a standby position into a working position supported by a stop in which the damping function can be performed.

20 Claims, 2 Drawing Sheets

(51) Int. Cl.

| | |
|---|---|
| ***A47B 88/473*** | (2017.01) |
| ***A47B 88/10*** | (2006.01) |
| ***E05F 3/04*** | (2006.01) |
| *E05F 5/02* | (2006.01) |

(52) U.S. Cl.
CPC ..... *E05F 5/003* (2013.01); *A47B 2210/0094* (2013.01); *E05F 5/02* (2013.01); *E05Y 2900/20* (2013.01)

(56) References Cited

U.S. PATENT DOCUMENTS

| | | | | |
|---|---|---|---|---|
| 2010/0293746 | A1* | 11/2010 | Johansson | E05F 1/16 16/85 |
| 2013/0076219 | A1* | 3/2013 | Lam | A47B 88/14 312/319.1 |
| 2014/0294328 | A1* | 10/2014 | Pecar | A47B 88/04 384/20 |
| 2015/0108891 | A1* | 4/2015 | Brunnmayr | A47B 88/0481 312/319.8 |
| 2016/0319582 | A1 | 11/2016 | Grabher | |

FOREIGN PATENT DOCUMENTS

| | | | |
|---|---|---|---|
| DE | 102012111551 | A1 | 5/2013 |
| DE | 20201301159 | U1 | 3/2015 |
| EP | 1625810 | A1 | 2/2006 |

OTHER PUBLICATIONS

Search Report in corresponding German Patent Application No. 202015006279.2, completed on Jun. 11, 2016.

* cited by examiner

DAMPING DEVICE FOR THE DAMPING OF THE OPENING MOVEMENT OF A MOVEABLE FURNITURE PART

CROSS REFERENCE TO RELATED APPLICATIONS

This application claims foreign priority under 35 U.S.C. § 119(a)-(d) to Application No. DE 202015006279.2 filed on Sep. 4, 2015, the entire contents of which are hereby incorporated by reference.

FIELD OF THE INVENTION

The invention relates to a damping device for the damping of the opening movement of a movable furniture part having a fixed base unit with a furniture body of a piece of furniture and a movable base unit having the movable furniture part, whereby the movable base unit is arranged movably relative to the fixed based unit, and having a damping unit comprising a first and a second damping component which are movable relative to one another when carrying out a damping function, of which the first damping component is arranged on the one base unit and as it approaches the movable base unit an impact takes place in the final position of said base unit between the second damping component and the other base unit, thereby triggering the damping function.

BACKGROUND

Damping devices for damping the opening and/or closing movement of movable furniture parts, for example drawers, doors or lids, have already been known for a long time. Damping the closing movement of a drawer into the closed position is for example known. During this process, a component that moves with the drawer comes into contact with a damping component, such as a displaceable damping housing or a displaceable damping piston, thereby triggering a damping function. When damping the opening movement of the drawer into the open position, the same principle is generally used.

The damping devices used for this always have damping components that can move relative to one another, for example as mentioned a movable damping piston which is guided movably into a damping housing or a moving damping housing which is guided movably to a damping piston. This means a moving damping component and a damping component which is fixed relative to the furniture body are used.

Given the narrow spatial conditions, however, it is often difficult to accommodate suitable damping devices. In particular, in the final position damping of a draw, during the opening movement there is a requirement for the damping device to be in the region of the drawer opening so the damping function is only triggered when the drawer is being opened into its open position. However, in this instance there is the problem of accommodating the damping devices due to the lack of space.

SUMMARY

The object of the invention is to create a damping device of the type mentioned at the start, the area of application of which is larger than conventional damping devices, in particular which can also be used functionally when there is only a small amount of space.

The damping device according to the invention is characterized in that the first damping component is movably mounted on the allocated base unit such that it can be displaced on impact from a standby position into a working position supported by slings, in which working position the damping function can be carried out. The relevant damping component is therefore initially displaced from the standby position into the working position before the damping function is carried out. It is for example conceivable that the movable base unit of the damping device is initially part of the movement of the drawer until slightly before the open position when it is being used for damping the opening movement of a movable part of furniture in the form of a drawer without a damping function being triggered, and this then being triggered once the working position is reached shortly before the fully extended open position of the drawer is reached. For example, the damping unit of the damping device can initially be displaced from the standby position into the working position, whereby in the working position the second damping component is moved relative to the first damping component in order to commence the damping function. It is for example possible for the damping unit of the damping device to extend at least in part from the drawer recess, as a result of which during the subsequent damping a relatively large damping stroke is available and the drawer can nevertheless still be almost completely extended from the drawer recess.

It is possible for the damping unit of the damping device to be arranged on the fixed base unit or alternatively on the movable base unit. Preferably, however, the damping unit is arranged on the fixed base unit, for example on a rail of the body on a guiding unit or on the furniture body of a piece of furniture.

In an embodiment of the invention the first damping component is movably mounted on a holder fixed to the allocated base unit.

Particularly preferably, the holder has the sling. In this case, the holder is multifunctional and is used on the one hand to guide the first damping component between the standby position and the working position and on the other hand the working position is defined as a stop by means of this holder.

As mentioned, it is particularly preferable for the first damping component to be arranged on the fixed base unit. Alternatively, however, it would be possible to arrange the first damping component on the movable base unit. In this case, the first damping component is also moved when the movable furniture part is moved.

In a further embodiment of the invention, the base unit not allocated to the first damping component, in particular a movable base unit, which has a carrying element, is the one which displaces the first damping component from the standby position into the working position on opening. In this case, the carrying element therefore comes into contact with the damping element during opening of the movable furniture part and causes the movement of the damping component from the standby position into the working position.

Particularly preferably, the carrying element triggers the damping function. It is therefore possible for the carrying element in the working position of the first damping component to cause a displacement of the first damping component relative to the second damping component, triggering a damping function.

It is possible that the carrying element will impact the second damping component and displace this together with the first damping component, whereby the latter is displaced from the standby position into the working position. Alternatively, however, it is possible for the carrying element to come into contact with the first damping component but for this not to cause a displacement of the first damping component relative to the second damping component, thereby triggering a damping function, but rather initially a displacement of the entire damping unit, so in particular the first damping component, from the standby position into the working position. Only once the working position has been reached is the first damping component displaced relative to the second damping component as a result of the further movement of the movable furniture part and the damping function triggered.

It is therefore possible for the carrying element to move the second damping component opposite the first damping component in the working position of the first damping component in order to trigger the damping function.

In a further embodiment of the invention the damping unit is formed as a linear damper with damping components which are movable in a linear relative to one another in order to trigger the damping function or as a rotation damper with damping components which are movable in a rotatable manner relative to one another in order to trigger the damping function.

In a further embodiment of the invention, a resetting mechanism is provided to reset the first damping component from the working position into the standby position.

It is possible for the resetting mechanism to have at least a spring element, the spring force of which resets the first damping component into the standby position as soon as the base unit which is not allocated to the first damping component is no longer in contact with the first damping component.

Alternatively or additionally, it is possible for the resetting mechanism to comprise a functional section of the base unit which is not allocated to the first damping component, which displaces the first damping component into the standby position on closing.

BRIEF DESCRIPTION OF THE DRAWINGS

A preferred embodiment of the invention is shown in the drawings and explained in greater detail below.

DETAILED DESCRIPTION

Figure 1:
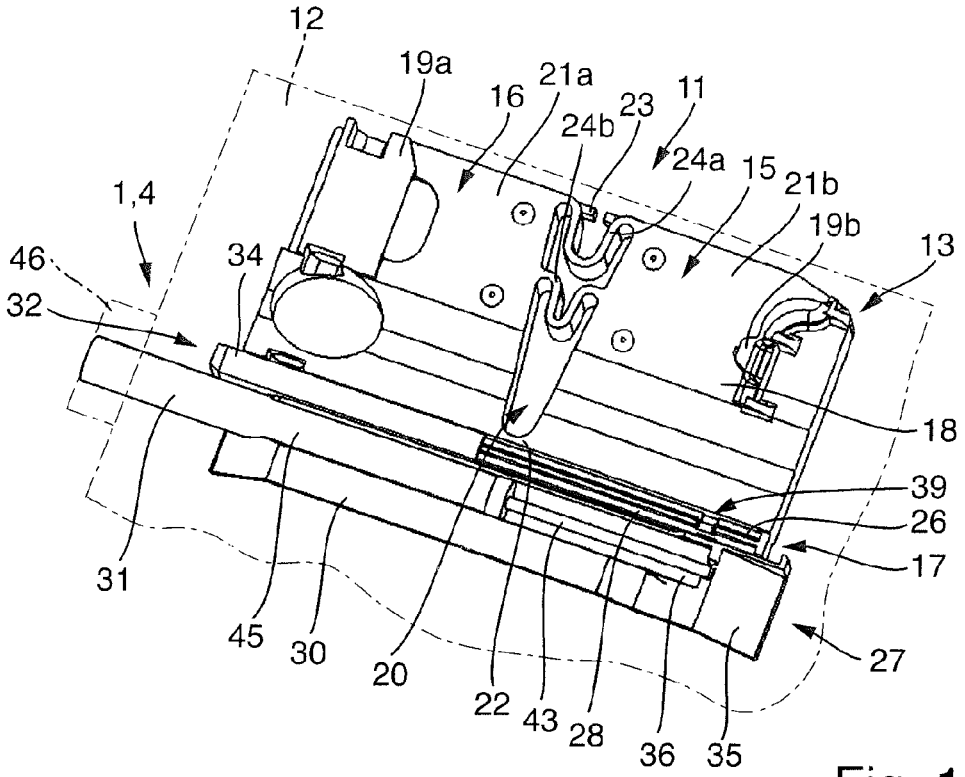
FIG. 1 is a perspective view of a preferred embodiment of the damping device according to the invention with the first damping component in the standby position.
Figure 2:
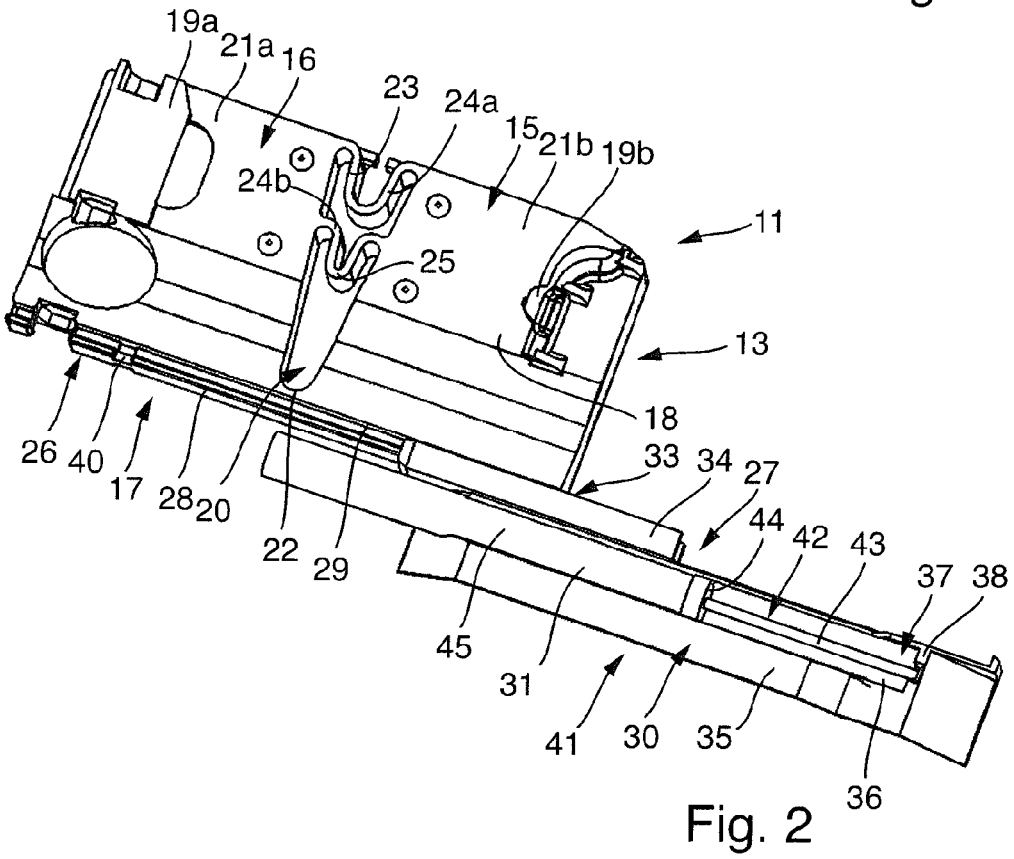
FIG. 2 is a perspective view of the damping device shown in FIG. 1, whereby the first damping component is displaced into the working position.

FIGS. 1 to 4 show a preferred embodiment of the damping device 11 according to the invention. The damping device is shown and described here by way of an example during use for damping the opening movement of a movable furniture part 12 in the form of a drawer.

The drawer is displaceably mounted relative to a furniture body (not shown) by means of a guiding device (not shown). The guiding device comprises several guiding units (not shown), of which two guiding units are allocated to opposite edges of the drawer.

The guiding units each have a body rail, which for example can be designed as a curved sheet metal part. The body rail is fastened in a fixed position to an allocated side wall of a drawer recess formed in the furniture body by appropriate fastening elements. A central rail (not shown) is displaceably mounted on the body rail, to which in turn a pull-out rail or a sliding rail is displaceably guided by a bearing mechanism. The pull-out rail is allocated to the drawer and runs in a downwards direction underneath the bottom of the drawer. The combination of a body rail, central rail and pull-out rail is known as full extension. It is conceivable, however, to use guide units without a central rail.

The damping device 11 comprises a fixed base unit 13 having the furniture body of the furniture. The damping device 11 further comprises a movable base unit 14 having the drawer, whereby the movable base unit 14 is arranged in a movable manner relative to the fixed base unit 13.

The fixed base unit 13 has an accessory carrier 15 having at least a mounting interface 16 for tool-free fastening to the furniture component and at least a fastening interface for the fastening of accessory parts to the accessory carrier 15.

As shown in FIGS. 1 to 4, the accessory carrier 15 is formed as a flat body, for example in the form of a carrier plate. The accessory carrier 15 is preferably made of plastics material. It is advantageous for the accessory carrier 15 to be a plastics material injection molded part, which means it can be reproduced many times over and manufactured in a simple and cost-effective manner.

In the example 2 shown, the mounting interface 16 is on an upper face 18 of the accessory carrier 15. The mounting interface 16 has first and second holding mechanisms 19*a*, 19*b*, by which the accessory carrier 15 can be detachably fixed to a mounting section of an allocated mounting bracket of the body rail.

The first and second holding mechanisms 19*a*, 19*b* overlap the mounting section on the mounting bracket when the accessory carrier 15 is mounted.

The accessory carrier 15 has a slit 20 running transverse to its longitudinal direction, which is open in the direction of a longitudinal side of the accessory carrier 15. The slit 20 is also formed by appropriate demolding during the manufacture of the accessory carrier 15, which is made of plastics material. The slit 20 diverges on the longitudinal side of the accessory carrier 15. In other words, the width of the slit 20 increases towards the longitudinal side of the accessory carrier 15.

The slit 20 separates the accessory carrier 15 into a first and a second carrier part 21*a*, 21*b*. The two carrier parts 21*a*, 21*b* are movable relative to one another such that the distance between the two holding mechanisms 19*a*, 19*b* for the mounting of the accessory carrier 15 on the allocated mounting section of the mounting bracket of the body rail can be increased using the slit. The two carrier parts 21*a*, 21*b* are connected to one another at the base of the slit 20 via a flexure bearing.

Springs 23 are arranged in the slit 20, the spring force of which works against the expansion of the slit 20. The springs 23 are connected in one piece to the two carrier parts 21*a*, 21*b*. In the example, the springs 23 comprise two loop-shaped leaf springs 24*a*, 24*b*, each of which is shaped at one end on one carrier part 21*a* and on the other end on the other carrier part 21*b*. The leaf springs 24*a*, 24*b* each have a loop section 25 which is in the slit width direction, approximately in the center of the slit 20. The loop sections 25 of the leaf springs 24*a*, 24*b* face one another.

As shown in FIGS. 1 to 4, the accessory carrier 15 has several fastening interfaces 17, one of which is formed on the longitudinal side of the accessory carrier 15, which is opposite the longitudinal side which also opens the slit 20. The fastening interface 17 on the longitudinal side of the accessory carrier 15 has a holder which essentially extends over the entire length of the accessory carrier 15 in the form of a guide rail 26 on which a damping unit 27 of the damping device 11 is guided in a linear, movable manner. The guide rail 26 forms a slide guide to guide the damping unit 27 on the accessory carrier 15. The guide rail 26 has a guard rail 28 which forms the outer longitudinal side termination of the accessory carrier 15. In the direction of the center of the accessory carried 15, there is a guide groove 29 on the upper and lower sides of the accessory carrier running in parallel to the guard rail 28.

As shown in particular by the Figures, the damping unit 27 has a first damping component 30 and a second damping component 31 which are movable relative to one another.

In the example shown, the first damping component is displaceably guided between a standby position 32 and a working position 33 on the guide rail 26 of the accessory carrier 15.

In order to do this, the first damping component 30 has a slit-like guide element 34 which encompasses the guard rail 28 on its upper and lower sides and penetrates the guide grooves 29 arranged behind this on the upper and lower sides of the accessory carrier 15. As the overview of FIGS. 1 to 4 shows, the slit-like guide element is guided between the standby position 32 and the working position 33 in a linear movable manner on the guide rail 26 of the accessory carrier 15.

The first damping component 30 further has an elongated base unit 35, the sides of which come into contact with the slit-like guide element 34, and in particular are connected in one piece with this. The base unit 35 is therefore also moved when the guide element 34 is moved. The longitudinal extension of the base unit 35 is significantly greater than that of the guide element 34.

The base unit 35 has a semi-cylindrical damping recess 36 extending in a longitudinal direction of the base unit 35 in order to receive and guide the second damping component 31. The damping recess 36 has an end stop 37 oriented in a transverse direction to the longitudinal extension of the damping recess, which is formed by a terminal wall 38.

As shown in particular in FIG. 1, the guide rail 26 has slings 39 which define the working position 33 of the first damping component 30. The slings 39 on the guard rail 28 include the notches 40 on the upper and lower edges, which in particular are arranged in pairs, in other words on the upper edge of the guard rail 28 two notches are arranged which are arranged at a distance from one another in the longitudinal direction of the guard rail and of which one is arranged in the region of the front and one in the region of the rear end of the guard rail, and to which corresponding notches 40 on the lower edge of the guard rail 28 are allocated. The notches 40 correspond to the protrusions formed on the slit-like guide element 34 (not shown).

The first damping component 30 further comprises components of a linear damper 41, namely a damper piston arrangement 42 having a piston rod 43 which is fastened on one side to the terminal wall 38 of the base unit 35 and formed in a fixed manner relative to the base unit. There is a damping piston 44 at the other end of the piston rod 43. The damping piston 44 is taken into a damping housing 45, which forms the main part of the second damping component 31. The damping housing 45 is movably guided in a linear manner in the damping recess 36 relative to the damping piston arrangement 42 using the piston rods 43 and the damping pistons 44.

As shown in particular in FIG. 1, the movable base unit 14 has a drawer, on the rear wall of which a carrier element 46 protruding over the base of the drawer is arranged.

On opening the drawer, the carrier element 46 comes into contact with the damping housing 45 of the second damping component 31 on the fixed base unit 13. This situation is set out in FIG. 1. When the carrier element 46 comes into contact with the rear front face of the damping housing 45, the full damping unit 27 and therefore the first damping component 30 which is in the standby position 32 (FIG. 1) is displaced with the base unit 35 and the damping piston arrangement 42 by the slit-like guide element 34 on the allocated guard rail 28 of the guide rail 26 being displaced in a linear manner. The force which has to be used for the displacement of the entire damping unit 27 is less than that which is required to displace the damping housing 45 relative to the damping piston arrangement 42. On impact of the carrier element 46 on the rear front face of the damping housing 45 no damping function is therefore triggered, but rather the damping housing 45 and the damping piston arrangement 42 and the base unit 35 of the first damping component 30.

The first damping component 30 together with the base unit 35 and the damping piston arrangement 42 is displaced from the standby position 32 into the working position 33 which is specified by the rear pair of notches in the direction of displacement.

It is characteristic for the base unit 35 to be moved out of the drawer recess in the working position 33 of the first damping component 30 by the damping piston arrangement 42. A damping function has therefore not yet taken place and the drawer can be opened to almost the open position before the damping function is initiated.

Figure 3:
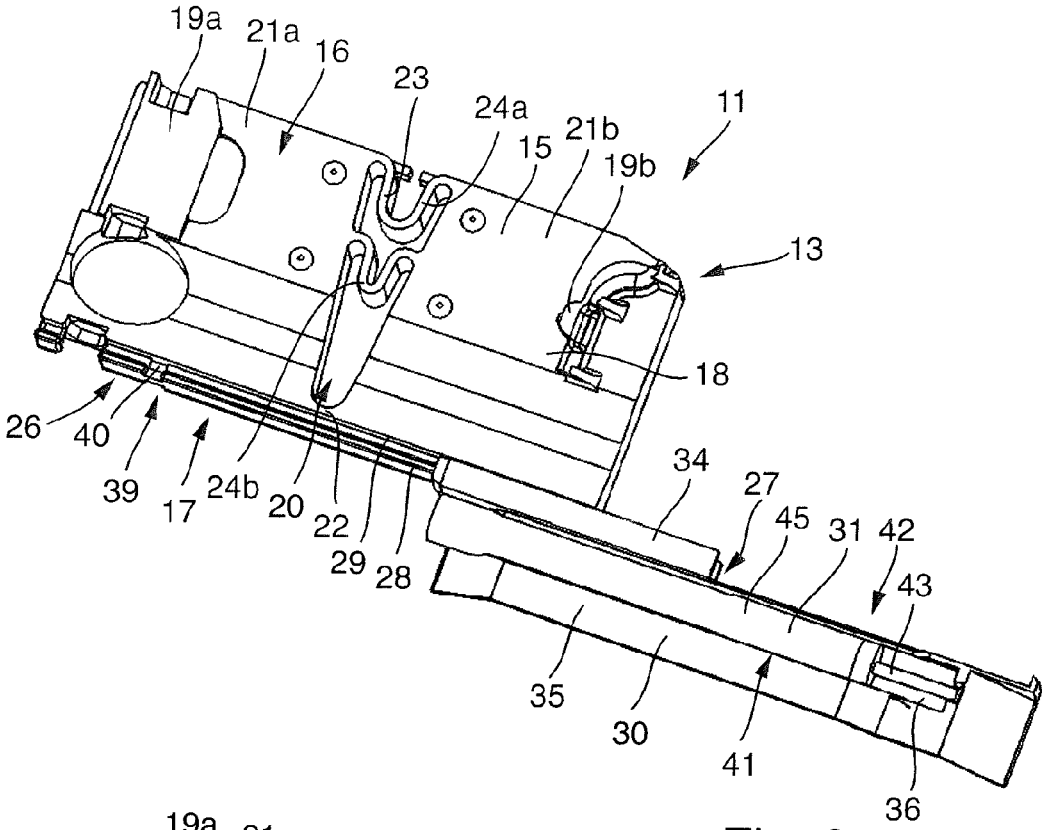
FIG. 3 is a perspective view of the damping device according to FIG. 1 in which a damping function has been initiated.
Figure 4:
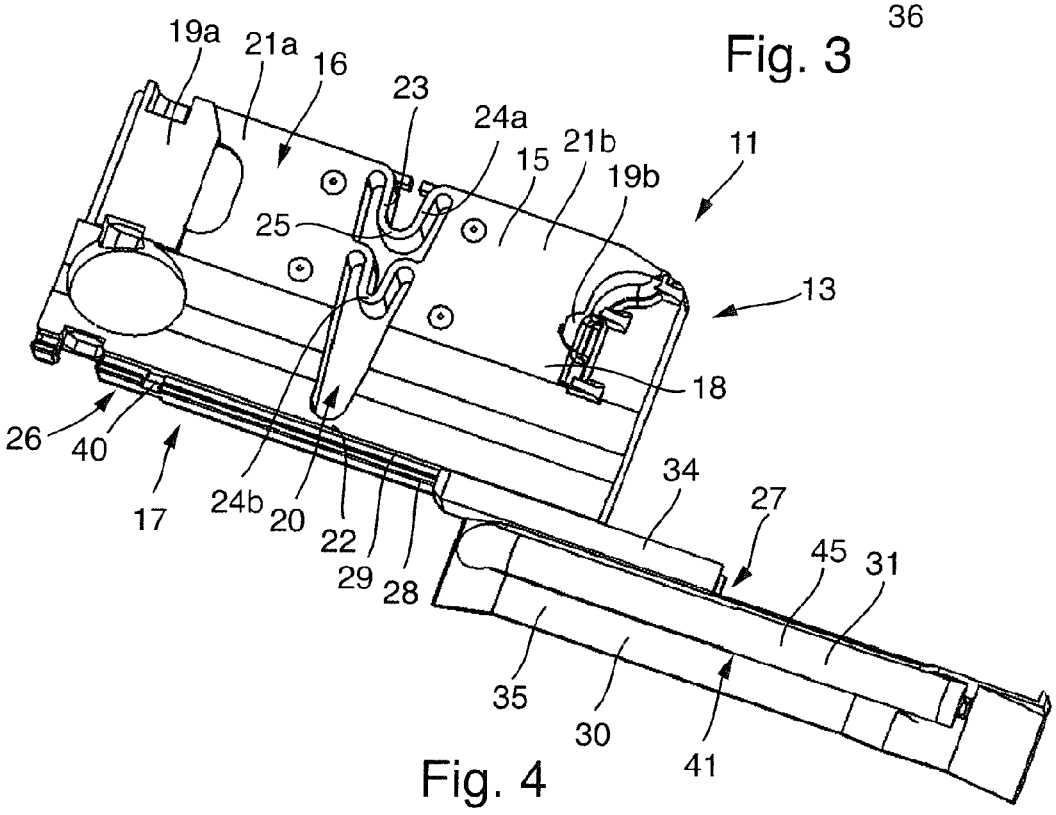
FIG. 4 is a perspective view of the damping device shown in FIG. 1, whereby the second damping component has completed the maximum damping stroke.

If the working position 33 of the first damping component 30 is reached, the damping housing 45 is then moved relative to the damping piston arrangement 42, in other words a damping function is triggered. As shown in FIGS. 3 and 4, in this process the damping housing 45 moves into the damping recess, whereby the damping piston 44 taken into the damping housing generates a damping function by the displacement of damping medium, in particular hydraulic oil or air, such that the moving of the drawer into the open position is braked and dampened.

When opening the drawer, the rear side of the drawer front comes into contact with the first damping component 30, as a result of which this is reset by the slide guide of the slit-like guide element 34 on the guard rail 28 from the working position 33 into the standby position 32. Prior to this, the damping housing 45 was reset by means of the loss of contact with the carrier element 46.

What is claimed is:

1. A damping device for the damping of the opening movement of a movable furniture part, comprising:

a fixed base unit with a furniture body of a piece of furniture;

a movable base unit having the movable furniture part, the movable base unit being arranged movably relative to the fixed based unit; and a damping unit comprising first and second damping components that are movable relative to one another when carrying out a damping function during the opening movement of the movable furniture part, wherein the first damping component is arranged on one of the base units and, as it approaches the movable base unit during the opening movement, an impact takes place in the final position of the one base unit between the second damping component and the other base unit to commence triggering of the damping function, wherein the first damping component is movably mounted on the one base unit such that on impact it can be displaced from a standby position into a working position supported by a stop in which the damping function can be carried out.

2. The damping device according to claim 1, wherein the first damping component is movably mounted on a holder fastened to the one base unit.

3. The damping device according to claim 2, wherein the holder comprises the stop.

4. The damping device according to claim 1, wherein the first damping component is arranged on the fixed base unit.

5. The damping device according to claim 1, wherein the movable base unit, which is not allocated to the first damping component, has a carrier element which displaces the first damping component from the standby position into the working position on opening.

6. The damping device according to claim 5, wherein the carrier element triggers the damping function.

7. The damping device according to claim 5, wherein the carrying element impacts the second damping component and displaces the second damping component together with the first damping component, whereby the first damping component is displaced from the standby position into the working position.

8. The damping device according to claim 7, wherein in the working position of the first damping component the carrier element moves the second damping component opposite the first damping component.

9. The damping device according to claim 1, wherein the damping unit is formed as a linear damper with damping components which are movable in a linear manner relative to one another in order to trigger the damping function or as a rotation damper with damping components which are movable in a rotatable manner relative to one another in order to trigger the damping function.

10. The damping device according to claim 1, wherein a resetting mechanism is provided to reset the first damping component from the working position into the standby position.

11. The damping device according to claim 10, wherein the resetting mechanism has at least a spring element, the spring force of which resets the first damping component into the standby position as soon as the base unit not allocated to the first damping component is no longer in contact with the first damping component.

12. The damping device according to claim 10, wherein the resetting mechanism comprises a functional section which of the base unit not allocated to the first damping component, which displaces the first damping component into the standby position on closing.

13. An item of furniture having at least one movable furniture part comprising a drawer, comprising the damping device according to claim 1.

14. A damping device for the damping of the opening movement of a movable furniture part, comprising:

a fixed base unit with a furniture body of a piece of furniture;

a movable base unit having the movable furniture part, the movable base unit being arranged movably relative to the fixed based unit; and a damping unit comprising a first damping unit component and a second damping component that are movable relative to one another when carrying out a damping function, of which the first damping component is arranged on one of the base units and as it approaches the movable base unit an impact takes place in the final position of the one base unit between the second damping component and the other base unit, thereby triggering the damping function, wherein the first damping component is movably mounted on the one base unit such that on impact it can be displaced from a standby position into a working position supported by a stop in which the damping function can be carried out, wherein the first damping component is movably mounted on a holder fastened to the one base unit, and wherein the holder comprises the stop.

15. An item of furniture having at least one movable furniture part comprising a drawer, comprising the damping device according to claim 14.

16. A damping device for the damping of the opening movement of a movable furniture part, comprising:

a fixed base unit with a furniture body of a piece of furniture;

a movable base unit having the movable furniture part, the movable base unit being arranged movably relative to the fixed based unit; and a damping unit comprising a first damping unit component and a second damping component that are movable relative to one another when carrying out a damping function, of which the first damping component is arranged on one of the base units and as it approaches the movable base unit an impact takes place in the final position of the one base unit between the second damping component and the other base unit, thereby triggering the damping function, wherein the first damping component is movably mounted on the one base unit such that on impact it can be displaced from a standby position into a working position supported by a stop in which the damping function can be carried out, and wherein the movable base unit, which is not allocated to the first damping component, has a carrier element which displaces the first damping component from the standby position into the working position on opening.

17. The damping device according to claim 16, wherein the carrier element triggers the damping function.

18. The damping device according to claim 16, wherein the carrying element impacts the second damping component and displaces the second damping component together with the first damping component, whereby the first damping component is displaced from the standby position into the working position.

19. The damping device according to claim 18, wherein in the working position of the first damping component the carrier element moves the second damping component opposite the first damping component.

20. An item of furniture having at least one movable furniture part comprising a drawer, comprising the damping device according to claim 16.

* * * * *